US007950938B1

(12) United States Patent
Teoh

(10) Patent No.: US 7,950,938 B1
(45) Date of Patent: May 31, 2011

(54) UNIVERSAL PLUG ADAPTER

(75) Inventor: Ling Fong Teoh, Penang (MY)

(73) Assignee: TZT Industry (M) SDN, BHD., Penang (MY)

( * ) Notice: Subject to any disclaimer, the term of this patent is extended or adjusted under 35 U.S.C. 154(b) by 0 days.

(21) Appl. No.: 12/850,847

(22) Filed: Aug. 5, 2010

(51) Int. Cl.
*H01R 29/00* (2006.01)

(52) U.S. Cl. ..... 439/171

(58) Field of Classification Search ..... 439/171–172, 439/332–333, 131–132
See application file for complete search history.

(56) References Cited

U.S. PATENT DOCUMENTS 6,097,881 A * 8/2000 DeWitt et al. ..... 392/392
7,381,067 B2 * 6/2008 Sze ..... 439/131
7,578,683 B2 * 8/2009 Zijlstra ..... 439/131
7,632,119 B1 * 12/2009 Ma et al. ..... 439/172
2007/0274012 A1 * 11/2007 Bonasia et al. ..... 361/42
* cited by examiner

*Primary Examiner* — Jean F Duverne
(74) *Attorney, Agent, or Firm* — Rosenberg, Klein & Lee

(57) ABSTRACT

A universal plug adapter is provided plugs of different specifications to be selectively extracted and positioned to meet and connect an external wall socket. The plug thus supplies power to a railed recess, in which railed recess a rail-positioned socket having different specifications is installed and electrically connected, so as to form the universal plug adapter. Therein, the rail-positioned socket has sockets of different specifications for plugs of different specifications to insert. Additionally, the rail-positioned socket rail-positioned socket may be tailed with a functional electric device, such as a nightlight, an alarm, a wireless router, a USB socket or sockets of different specifications, for easy and convenient use.

2 Claims, 9 Drawing Sheets

UNIVERSAL PLUG ADAPTER

BACKGROUND OF THE INVENTION

1. Technical Field

The present invention relates to a universal plug adapter for adapting plugs of various specifications to different wall sockets.

2. Description of Related Art

Presently, different specifications of plugs and sockets are adapted in different countries. Since electric appliances have been widely circulated all over the world, when an imported electric appliance with a plug not conforming with the local socket specification, a plug adapter is necessary for electric connection between the electric appliance and the grid. As there are so many different specification of plugs used in different countries, a user may have to prepare that many plug adapters for proper electric connection.

On the other hand, travel for both business and leisure purposes is common nowadays, and when people travel with their own laptop computers, mobile phones and other portable electric devices, the difference between specifications for power plugs and sockets in different countries, such as Japan and UK, can cause significant inconvenience because plural plug adapters have to be bought and carried in the luggage.

In view of the shortcomings of the existing devices to be improved, the inventor of the present invention deliberated solutions for enhancing practicability and convenience in use. After his repeated researches and tests, a universal plug adapter that meets specifications for power plugs and sockets in different countries as disclosed herein was invented.

SUMMARY OF THE INVENTION

The primary objective of the present invention is to provide a universal plug adapter, which includes plugs of different specifications to be selectively extracted and positioned to meet and connect an external wall socket further associated to a power source, so that the rail-positioned sockets that have different specifications and are selectively installed in the railed recess can be powered by the power source, thereby achieving easy and convenient use.

BRIEF DESCRIPTION OF THE DRAWINGS

The invention as well as a preferred mode of use, further objectives and advantages thereof will be best understood by reference to the following detailed description of illustrative embodiments when acquire in conjunction with the accompanying drawings, wherein.

DETAILED DESCRIPTION OF THE INVENTION

Figure 1:
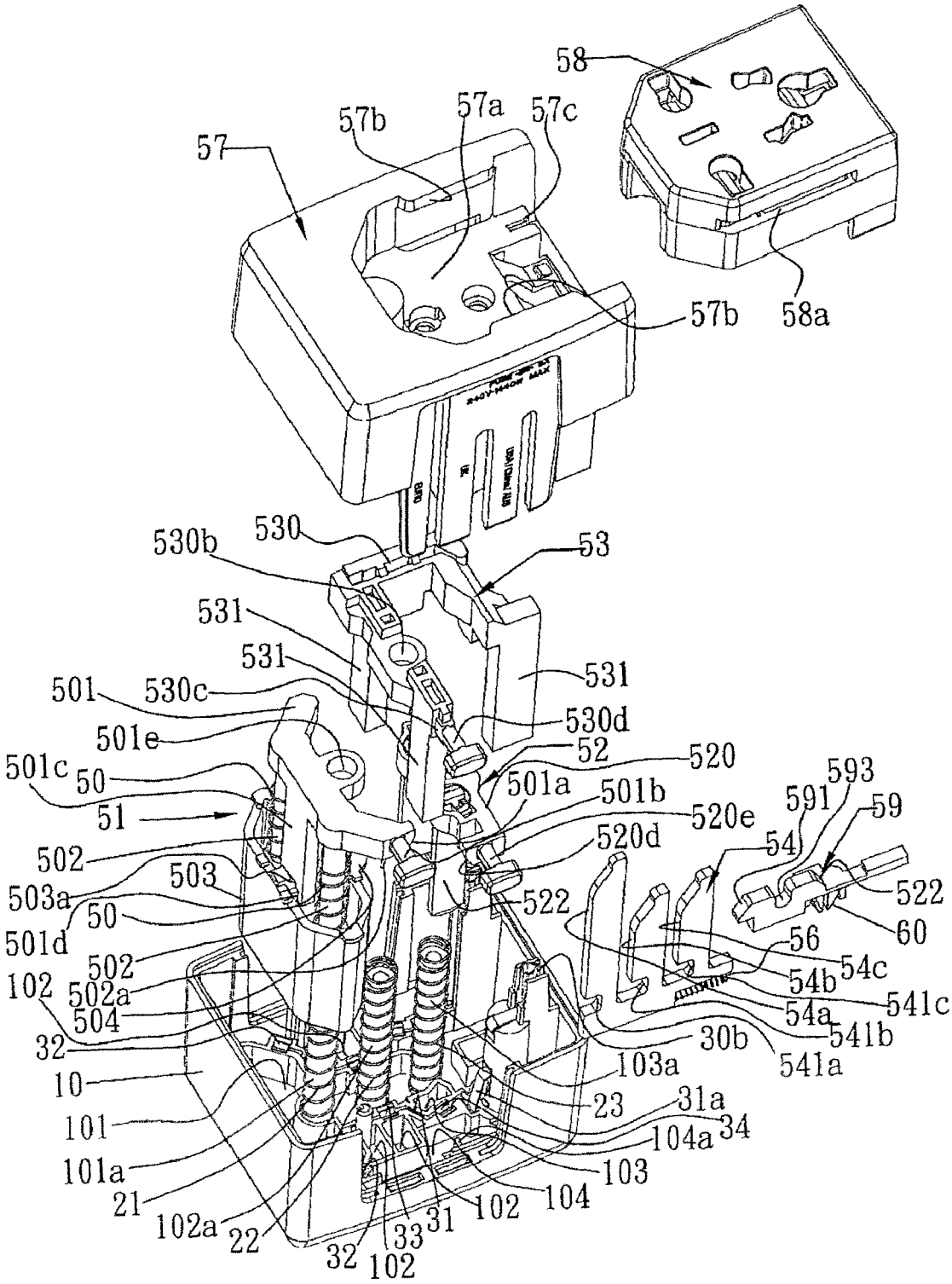
FIG. 1 is an exploded view of a universal plug adapter according to the present invention.
Figure 2:
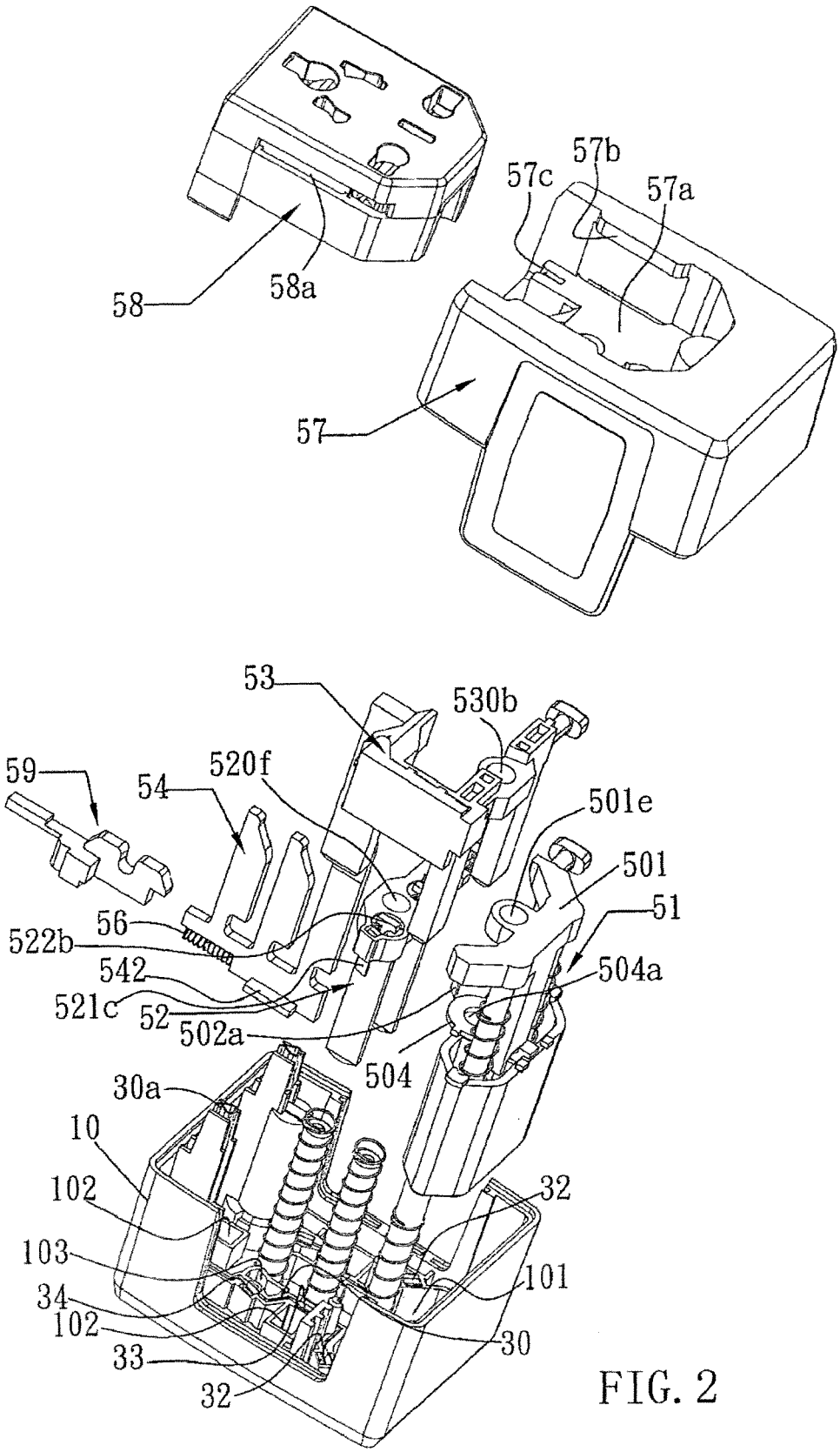
FIG. 2 is another exploded view of the universal plug adapter according to the present invention.

FIGS. 1 and 2 are exploded views of a universal plug adapter according to the present invention. The universal plug adapter comprises the following components.

Figure 5:
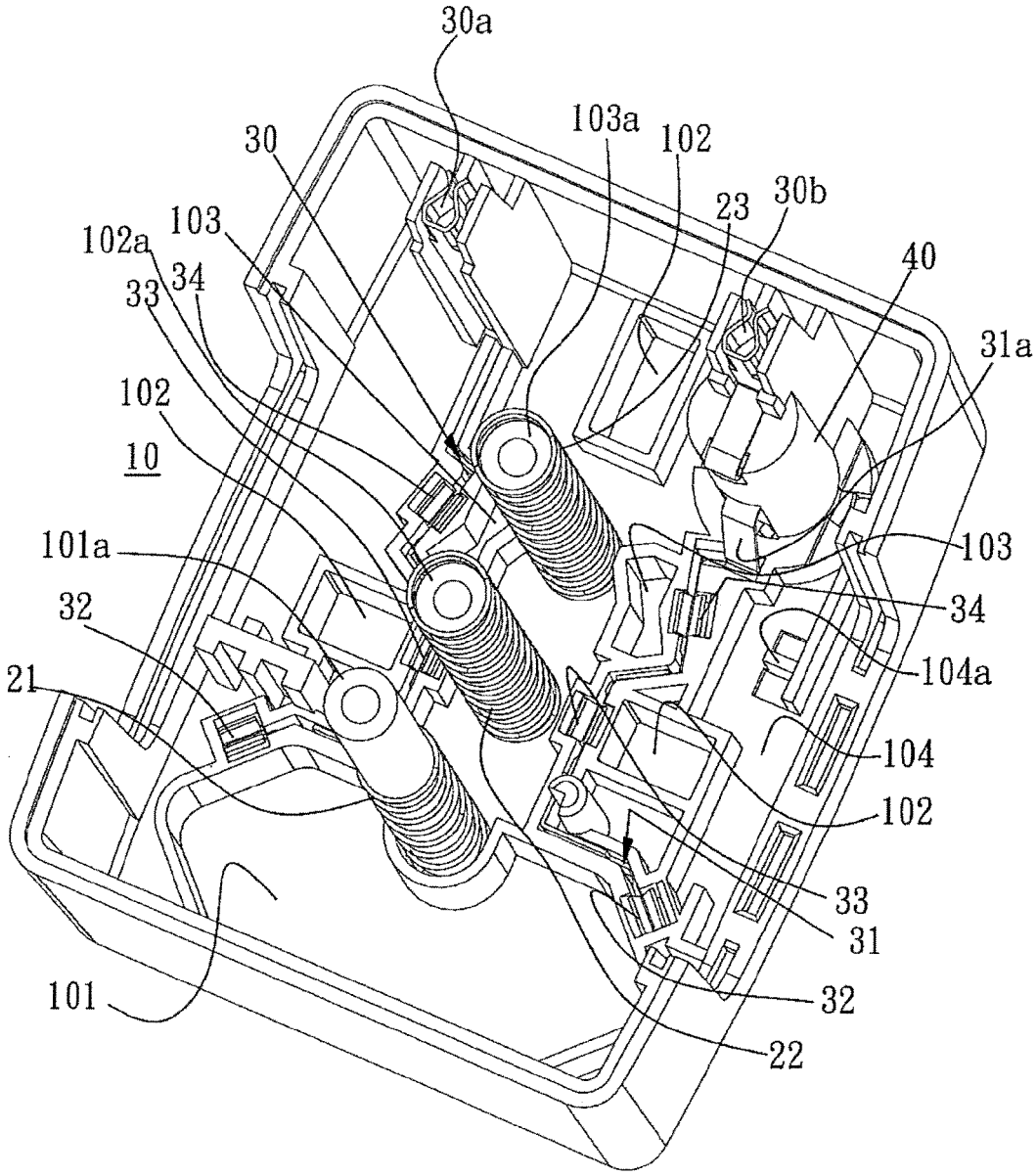
FIG. 5 is a perspective view of a lower shell unit according to the present invention.

A lower shell unit 10 (referring to FIG. 5) has primarily therein an A-terminal hole 101, B-terminal holes 102 and C-terminal holes 103, a movable rail portion 104 at one side thereof with a protrusion 104*a*, a plurality of posts 101*a*, 102*a* and 103*a* mounted therearound with springs 21, 22 and 23, and two metal conducting plates 30 and 31 inlaid and extending along edges of the A-terminal hole 101, B-terminal holes 102 and C-terminal holes 103. The two metal conducting plates 30 and 31 are formed with conducting clamps 32, 33 and 34 near the edges of the A-terminal hole 101, B-terminal holes 102 and C-terminal holes 103. In addition, the metal conducting plate 30 has one end bent upward to form a power-source clamp 30*a*, and the other metal conducting plate 31 has one end bent upward to form an abutting portion 31*a* to abut against a fuse 40. Moreover, a power-source clamp 30*b* is provided above the fuse 40.

A Specification-A plug 51 (also referring to FIGS. 5 and 13) has a base 501 and two terminals 502 each mounted therearound with a spring 50. The two terminals 502 are extended with pins 502*a* for engaging and electrically connecting the conducting clamps 32 of the two metal conducting plates 30 and 31. The base 501 is centrally formed with an axial tube 501*e*, and unilaterally formed with an inclined plane 501*a* as well as a pressing lever 501*b*. The base 501 centrally has a downward extended hooked plate 501*c* that is provided with a hook 501*d*. In addition, a casing 503 is formed with two axially extending holes for movably receiving the two terminals 502 therein. The casing 503 further has a hook 503*a* for engaging the hook 501*d* on the hooked plate 501*c* of the base 501 so as to restrict the terminals 502 of the base 501 from leaving the casing 503. The casing 503 has a ledge 504 near the top thereof and the ledge 504 is formed with a through hole 504*a*. The through hole 504*a* together with the axial tube 501*e* of the base 501 is for the post 101*a* of the lower shell unit 10 to insert, while the casing 503 of the Specification-A plug 51 is movable to and fro with respect to the A-terminal hole 101.

Figure 3:
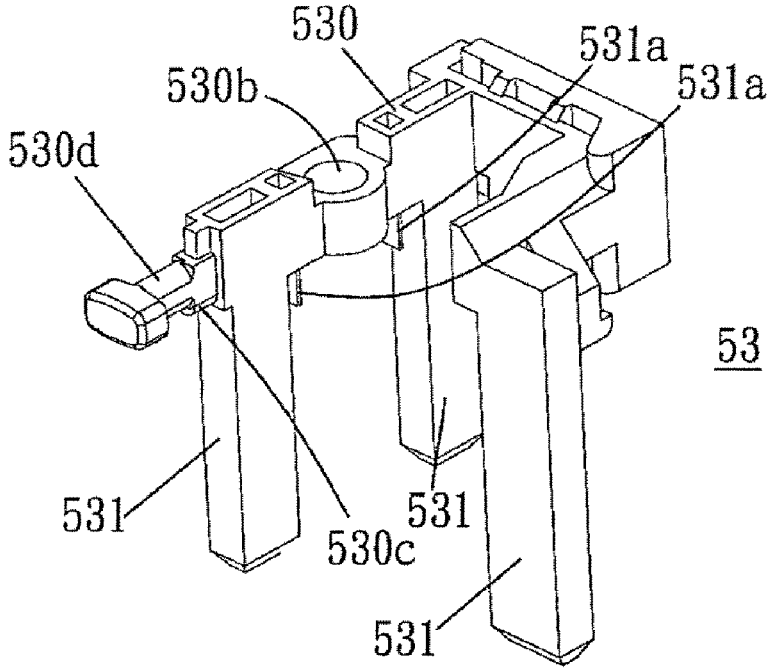
FIG. 3 is a perspective view of a Specification-B plug according to the present invention.

A Specification-B plug 53 (also referring to FIGS. 3, 5 and 11) has a base 530 and a plurality of terminals 531 attached to the base 530. Each said terminal 531 has an extended pin 531*a* for correspondingly inserting to and electrically connecting the conducting clamps 33 of the metal conducting plates 30 and 31 in the lower shell unit 10. The base 530 is centrally formed with an axial tube 530*b*, and unilaterally formed with a positioning block 530*c* as well as a pressing lever 530*d*. Therein, the axial tube 530*b* is for the post 102*a* of the lower shell unit 10 to insert while the terminals 531 of the Specification-B plug 53 are removable to and fro with respect to the B-terminal holes 102 in the lower shell unit 10.

Figure 6:
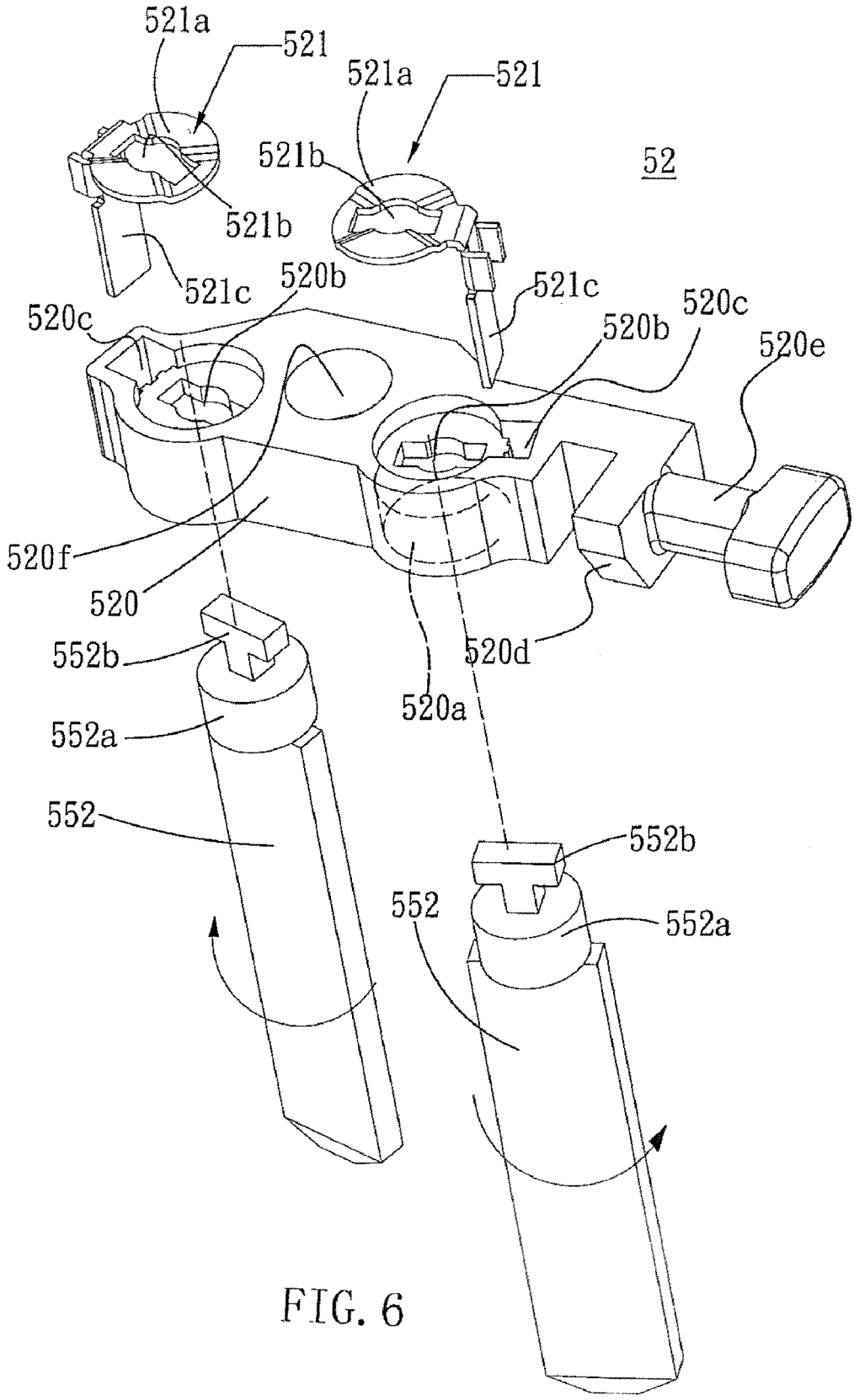
FIG. 6 is an exploded view of a Specification-C plug according to the present invention.

A Specification-C plug 52 (also referring to FIGS. 5, 6 and 9) has a base 520 formed with two recesses 520*a*, slots 520*b* and notches 520*c* each at a side of one of the recesses 520*a*. The base 520 is unilaterally formed with an inclined plane 520*d* and a pressing lever 520*e*. Two conducting pins 521 each include a top panel 521*a* formed with a slot 521*b*. The top panel 521*a* has raised and depressed portions and has a pin 521*c* to be inserted to and thereby positioned in the notch 520*c* of the base 520. The pins 521*c* of the conducting pins 521 are for being inserted to and electrically connected with the conducting clamps 34 of the two metal conducting plates 30 and 31 in the lower shell unit 10. Therein, the slots 520*b* in the two recesses 520*a* of the base 520 together with the slots 521*b* on the top panels 521*a* are for positioning T-shaped retainers 522*b* and in turn axial columns 522*a* of the terminals 522 by inserting and then rotating the T-shaped retainers 522*b* in the slots 520*b* and 521*b*, so as to make the two terminals positioned in parallel. Therein, the raised portions of the top panel 521*a* abut against the T-shaped retainer 522*b* for preventing looseness. The two terminals 522 are rotatable to form a splay configuration with each other, so as to be used as a plug of another specification. The base 520 is centrally formed with an axial hole 520*f* for the post 103*a* of the lower shell unit 10 to insert while the terminals 522 of the Specification-C plug 52 are movable to and fro with respect to the B-terminal holes 103 in the lower shell unit 10.

A movable locking plate 54 is formed with a plurality of guiding surfaces 54*a*, 54*b*, 54*c* and engaging notches 541*a*, 541*b*, 541*c*. Each of the guiding surfaces 54*a*, 54*b*, 54*c* includes a slanting section followed by a vertical section that connects the corresponding engaging notch 541*a*, 541*b* or 541*c*. In addition, a spring 56*a* is mounted around a post at one side of the bottom of the movable locking plate 54 while a bottom plate 542 juts out of an opposite side of the bottom of the movable locking plate 54. The movable locking plate 54 is received in the movable rail portion 104 of the lower shell unit 10 in a transversely to-and-fro movable manner.

A movable positioning unit 59 has its bottom formed with a spring seat for receiving a W-shaped spring 60. The movable positioning unit 59 has its top formed with two oblique abutting surfaces 591, 592 and a dent 593 therebetween. Furthermore, the movable positioning unit 59 is to be received in the movable rail portion 104 of the lower shell unit 10 with one side of the bottom of the movable positioning unit 59 pressing on the bottom plate 542 of the movable locking plate 54. Meantime, the W-shaped spring 60 at the other side with a middle depressed part inserted in and positioned by the protrusion 104*a* of the movable rail portion 104 in the lower shell unit 10. The movable positioning allows the W-shaped spring 60 to push the movable positioning unit 59 to bilaterally move.

An upper shell unit 57 has vertically formed with a plurality of through holes for allowing the pressing levers 501*b*, 520*e*, 530*d* of the Specification-A plug 51, Specification-B plug 52, and Specification-C plug 53 to move therein. The upper shell unit 57 further has atop a railed recess 57*a*, which has bilaterally rails 57*b* and has two notches 57*c* facing an opening thereof so that upon combination between the upper shell unit 57 and the lower shell unit 10, the notches 57*c* serve to receive and position the power-source clamp 30*a* of the metal conducting plate 30 and the power-source clamp 30*b* of the metal conducting plate 31.

Figure 4:
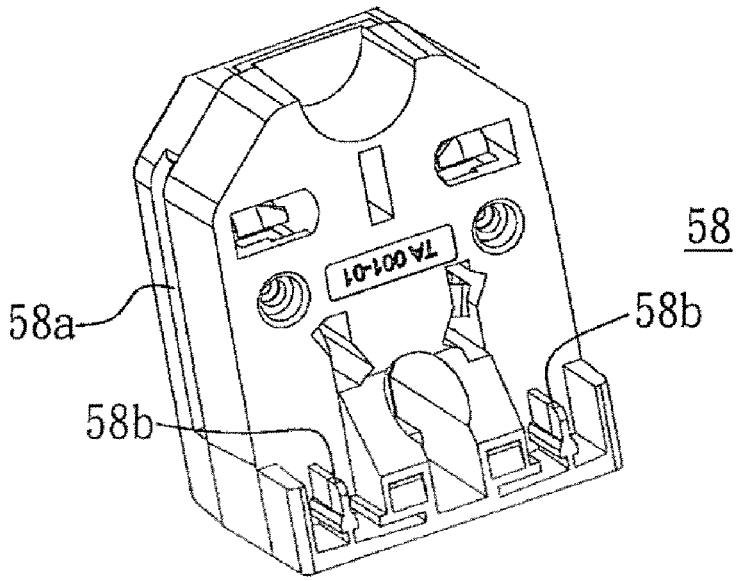
FIG. 4 is a perspective view of a rail-positioned socket according to the present invention.
Figure 7:
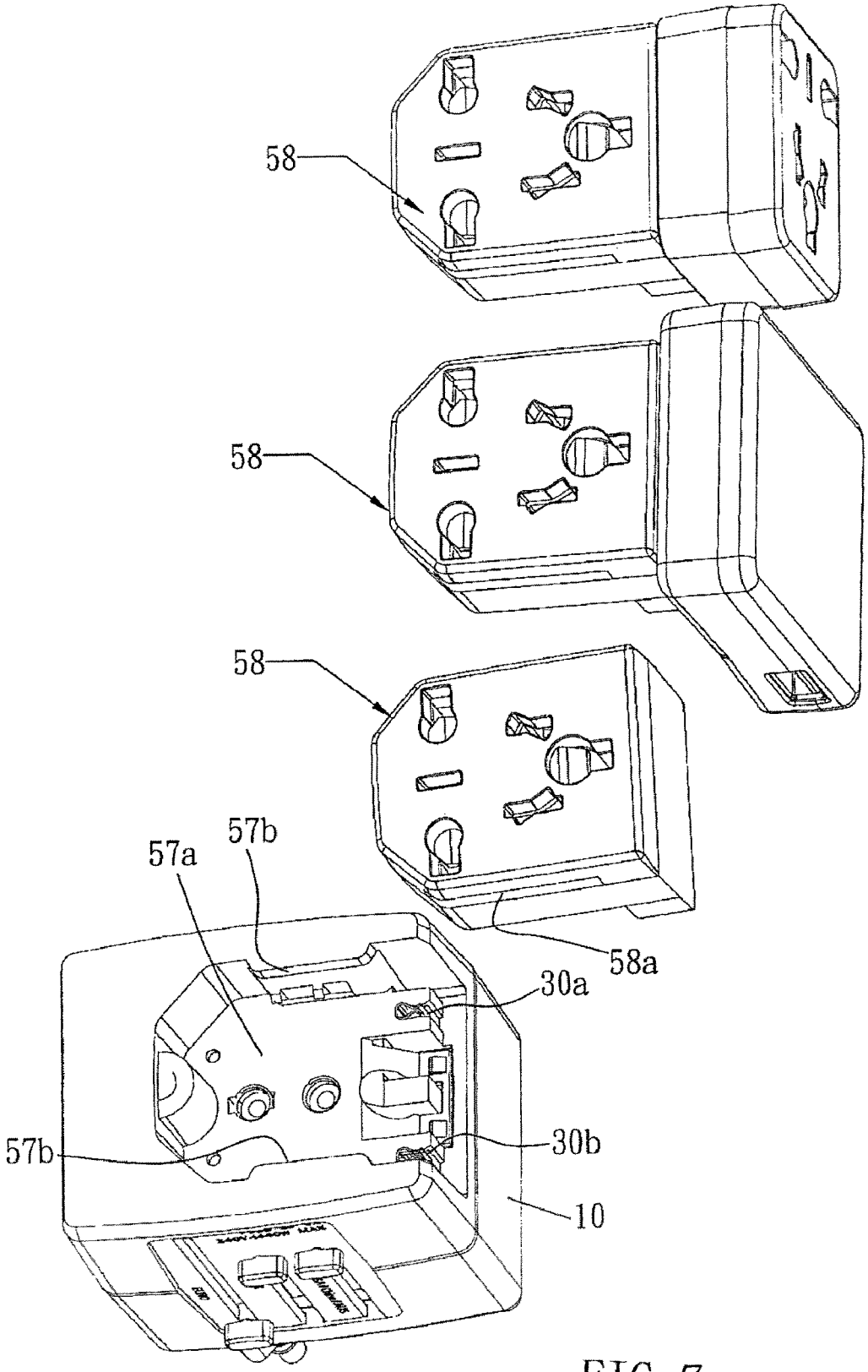
FIG. 7 is a perspective view showing embodiments of the rail-positioned socket according to the present invention.

A rail-positioned socket 58 (also referring to FIG. 4) has sockets of various specifications. The rail-positioned socket 58 has bilaterally grooves 58*a* and has its bottom formed with two raised abutting pins 58*b*. Therein, the grooves 58*a* are for engaging the rails 57*b* of the upper shell unit 57 while the abutting pins 58*b* are for being inserted in and electrically connected to the power-source clamps 30*a*, 30*b* positioned in the notches 57*c*. Moreover, the rail-positioned socket 58 may be optionally tailed with various functional electric devices, such as a nightlight, an alarm, a wireless router, a USB socket or sockets of different specifications (FIG. 7) for easy and convenient use.

Figure 8:
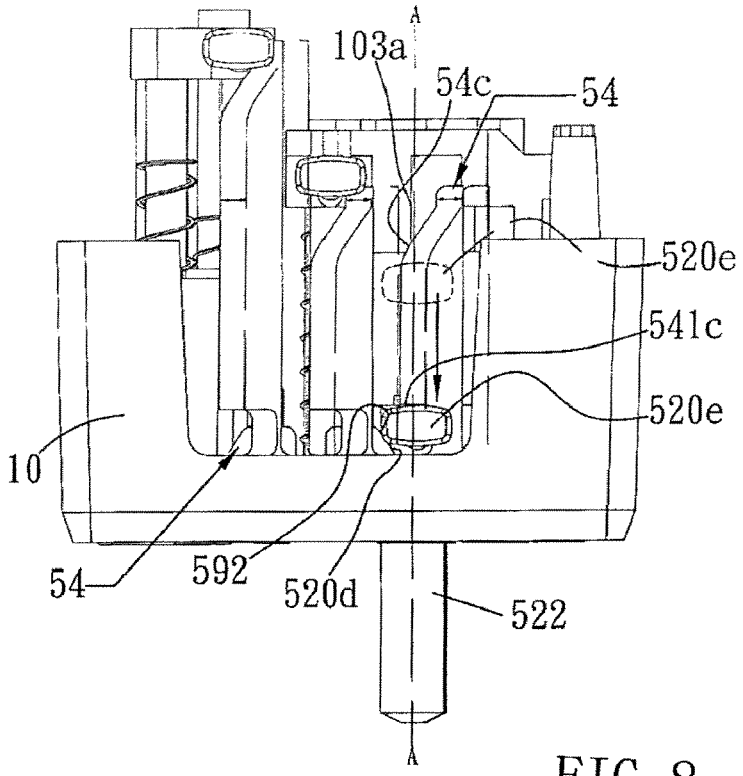
FIG. 8 is a schematic view showing switch of the Specification-C plug.
Figure 9:
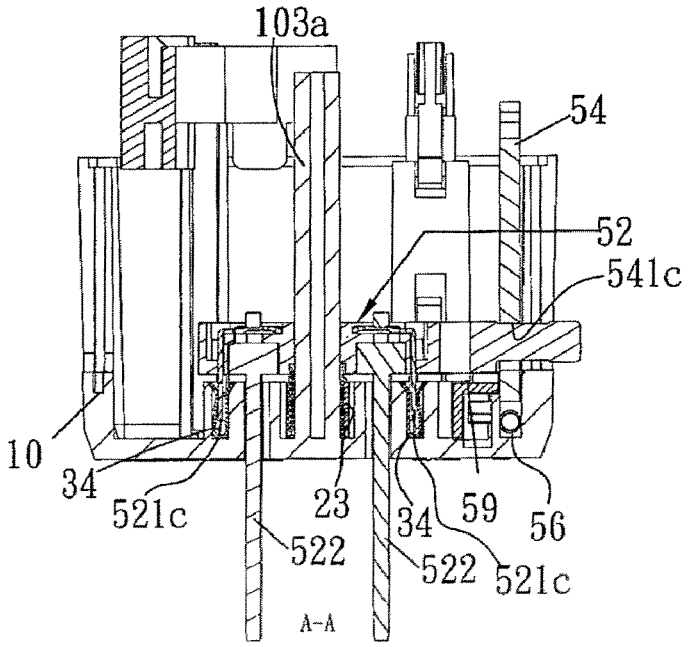
FIG. 9 is a cross-sectional view of the Specification-C plug taken along Line A-A of FIG. 8.

As shown in FIGS. 8 and 9 (also referring to FIG. 1), as a result of pressing the pressing lever 520*e* of the Specification-C plug 52 downward, the entire Specification-C plug 52 is lowered. The guiding surfaces 54*c* of the movable locking plate 54 replaced under the pushing force of the pressing lever 520*e*. The Specification-C plug 52 smoothly descends and its two terminals 522 thus jut out of the lower shell unit 10. At this time, the two pins 521*c* are engaged by the conducting clamps 34, and the spring 56 of the movable locking plate 54 pushes the movable locking plate 54 to its initial position. Thereby, the engaging notch 541*c* holds and positions the pressing lever 520*e* while the oblique abutting surface 592 of the movable positioning unit 59 abuts against the inclined plane 520*d* of the Specification-C plug 52 so as to reinforce the combination.

Figure 10:
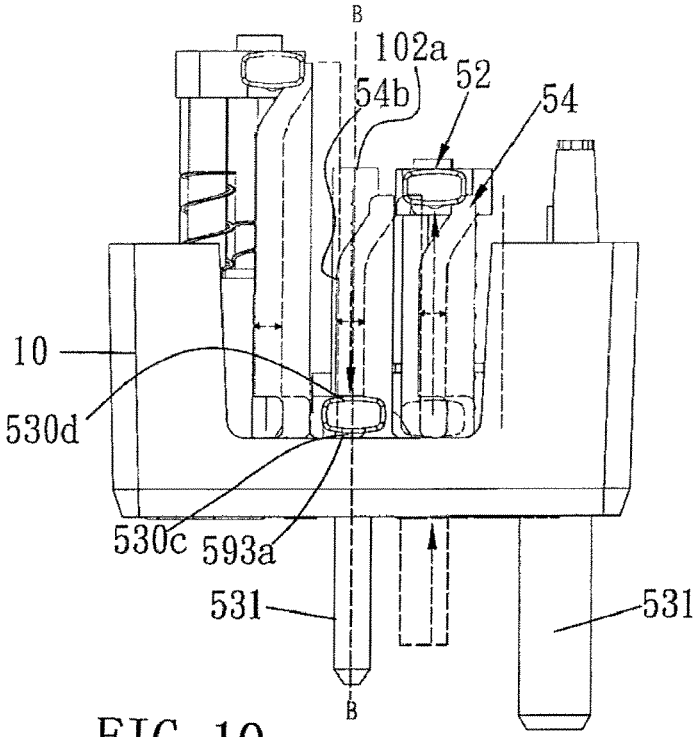
FIG. 10 is a schematic view showing switch of the Specification-B plug.
Figure 11:
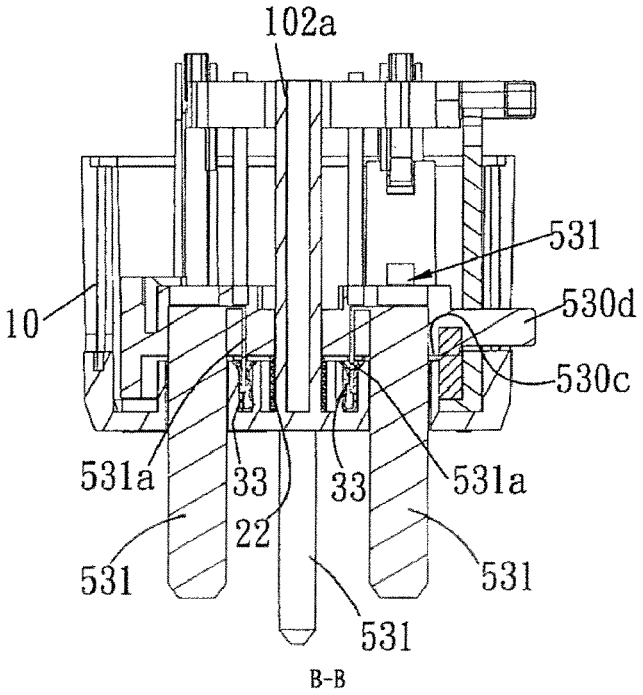
FIG. 11 is a cross-sectional view of the Specification-B plug taken along Line B-B of FIG. 10.

As shown in FIGS. 10 and 11 (also referring to FIG. 1), by pressing the pressing lever 530*d* of the Specification-B plug 53 downward, the entire Specification-B plug 53 is lowered. The guiding surfaces 54*b* of the movable locking plate 54 is replaced under the pushing force of the pressing lever 530*d*. The Specification-B plug 53 smoothly descends and its terminals 531 jut out of the lower shell unit 10. The two pin 531*a* thus are engaged by the conducting clamps 33. At this time, the entire Specification-C plug 52 is lifted and positioned, and the spring 56 of the movable locking plate 54 pushes the movable locking plate 54 back to its initial position to make its engaging notch 541*b* position the pressing lever 530*d* while the dent 593*a* of the movable positioning unit 59 receives the positioning block 530*c* of the Specification-B plug 53.

Figure 12:
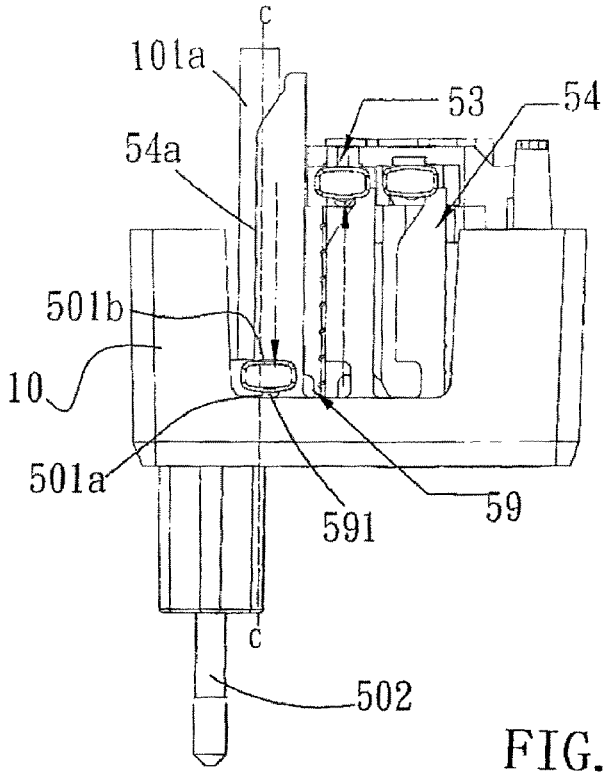
FIG. 12 is a schematic view showing switch of the Specification-A plug.
Figure 13:
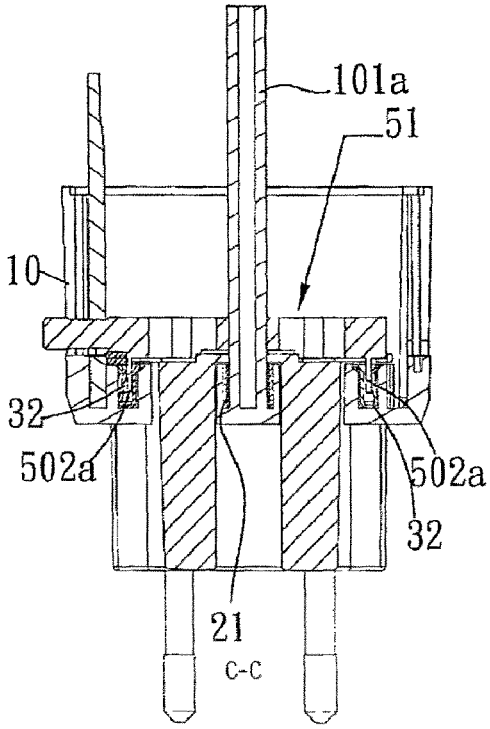
FIG. 13 is a cross-sectional view of the Specification-A plug taken along Line C-C of FIG. 12.

As shown in FIGS. 12 and 13 (also referring to FIG. 1), pressing the pressing lever 501*b* of the Specification-A plug 51 lowers the entire Specification-A plug 51. The guiding surfaces 54*a* of the movable locking plate 54 is pushed to replace by the pressing lever 501*b*. The Specification-A plug 51 smooth descends so the terminals 502 are lowered and thus jut out of the lower shell unit 10. The two pins 502*a* are engaged by the conducting clamps 32. At this time, the entire Specification-B plug 53 is lifted and positioned, and the spring 56 of the movable locking plate 54 pushes the movable locking plate 54 back to its initial position to make its engaging notch 541*a* position the pressing lever 501*b*. Meantime, the oblique abutting surface 591 of the movable positioning unit 59 abuts against the inclined plane 501*a* of the Specification-A plug 51 so as to ensure the engagement.

What is claimed is:

1. A universal plug adapter, comprising:

a lower shell unit having primarily therein an A-terminal hole, B-terminal holes and C-terminal holes, a movable rail portion at one side thereof with a protrusion, a plurality of posts mounted therearound with springs, and two metal conducting plates inlaid and extending along edges of the A-terminal hole, the B-terminal holes and the C-terminal holes, the two metal conducting plates being formed with conducting clamps near the edges of the A-terminal hole, B-terminal holes and C-terminal holes, the metal conducting plate having one end bent upward to form a power-source clamp, the other metal conducting plate having one end bent upward to form an abutting portion to abut against a fuse, and a power-source clamp being provided above the fuse;

a Specification-A plug having a base and two terminals each mounted therearound with a spring, the two terminals being extended with pins for engaging and electrically connecting the conducting clamps of the two metal conducting plates, the base being centrally formed with an axial tube and unilaterally formed with an inclined plane as well as a pressing lever, the base centrally having a downward extended hooked plate that is provided with a hook, a casing having a being formed with two axially extending holes for movably receiving the two terminals therein, the casing further having a hook for engaging the hook on the hooked plate of the base so as to restrict the base from leaving the casing, the casing having a ledge near the top thereof and the ledge being formed with a through hole, the through hole together with the axial tube of the base being for the post of the lower shell unit to insert, and the casing of the Specification-A plug being movable to and fro with respect to the A-terminal hole;

a Specification-B plug having a base and a plurality of terminals attached to the base, each said terminal having an extended pin for correspondingly inserting to and electrically connecting the conducting clamps of the metal conducting plates in the lower shell unit, the base being centrally formed with an axial tube and unilaterally formed with a positioning block as well as a pressing lever, the axial tube being for the post of the lower shell unit to insert and the terminals of the Specification-B plug removable to and fro with respect to the B-terminal holes in the lower shell unit;

a Specification-C plug having a base formed with two recesses, slots and notches each at a side of one of the recesses, the base being unilaterally formed with an inclined plane and a pressing lever, two conducting pins each including a top panel formed with a slot, the top panel having raised and depressed portions and having a pin to be inserted to and thereby positioned in the notch of the base, the pins of the conducting pins for being inserted to and electrically connected with the conducting clamps of the two metal conducting plates in the lower shell unit, the slots in the two recesses of the base together with the slots on the top panels positioning T-shaped retainers and in turn axial columns of the terminals by inserting and then rotating the T-shaped retainers in the slots, so as to make the two terminals positioned in parallel, the raised portions of the top panel abutting against the T-shaped retainer for preventing looseness, the two terminals being rotatable to form a splay configuration with each other, so as to be used as a plug of another specification, the base being centrally formed with an axial hole for the post of the lower shell unit insert, and the terminals of the Specification-C plug being movable to and fro with respect to the B-terminal holes in the lower shell unit;

a movable locking plate being formed with a plurality of guiding surfaces and engaging notches, each of the guiding surfaces including a slanting section followed by a vertical section that connects the corresponding engaging notch, a spring being mounted around a post at one side of a bottom of the movable locking plate, a bottom plate jutting out of an opposite side of the bottom of the movable locking plate, the movable locking plate being received in the movable rail portion of the lower shell unit in a transversely to-and-fro movable manner;

a movable positioning unit having a bottom formed with a spring seat for receiving a W-shaped spring, the movable positioning unit having a top formed with two oblique abutting surfaces and a dent therebetween, the movable positioning unit being received in the movable rail portion of the lower shell unit with one side of the bottom of the movable positioning unit pressing on the bottom plate of the movable locking plate, the W-shaped spring at the other side with a middle depressed part inserted in and positioned by the protrusion of the movable rail portion in the lower shell unit, and the movable positioning allowing the W-shaped spring to push the movable positioning unit to bilaterally move;

an upper shell unit having vertically formed with a plurality of through holes for allowing the pressing levers of the Specification-A plug, the Specification-B plug, and the Specification-C plug to move therein, and the upper shell unit further having atop a railed recess, which has bilaterally rails and has two notches facing an opening thereof so that upon combination between the upper shell unit and the lower shell unit, the notches serve to receive and position the power-source clamp of the metal conducting plate and the power-source clamp of the metal conducting plate; and a rail-positioned socket having sockets of various specifications, the rail-positioned socket having bilaterally grooves and having its bottom formed with two raised abutting pins, the grooves engaging the rails of the upper shell unit, the abutting pins being inserted in and electrically connected to the power-source clamps positioned in the notches.

2. The universal plug adapter of claim 1, wherein the rail-positioned socket is tailed with a functional electric device and the functional electric device is a nightlight, an alarm, a wireless router, a USB socket or sockets of different specifications.

* * * * *